US012565775B2

(12) United States Patent
DaSilva

(10) Patent No.: US 12,565,775 B2
(45) Date of Patent: Mar. 3, 2026

(54) LOCKING SOFFIT

(71) Applicant: Alpha Aluminum, Inc, Orlando, FL (US)

(72) Inventor: Jose Julio DaSilva, Orlando, FL (US)

(73) Assignee: Alpha Aluminum, Inc, Orlando, FL (US)

( * ) Notice: Subject to any disclaimer, the term of this patent is extended or adjusted under 35 U.S.C. 154(b) by 0 days.

(21) Appl. No.: 19/054,943

(22) Filed: Feb. 17, 2025

(65) Prior Publication Data

US 2025/0277369 A1 Sep. 4, 2025

Related U.S. Application Data

(60) Provisional application No. 63/559,934, filed on Mar. 1, 2024.

(51) Int. Cl.
*E04D 13/16* (2006.01)
*E04D 13/158* (2006.01)

(52) U.S. Cl.
CPC ..... *E04D 13/158* (2013.01)

(58) Field of Classification Search
CPC ..... E04D 13/158
USPC ..... 52/93.2, 94, 95
See application file for complete search history.

(56) References Cited

U.S. PATENT DOCUMENTS

| | | | | | |
|---|---|---|---|---|---|
| 3,170,266 | A * | 2/1965 | Roberts | E04D 13/158 | 52/11 |
| 3,181,275 | A * | 5/1965 | Wood | E04D 13/158 | 52/73 |
| 4,189,885 | A | 2/1980 | Fritz | | |
| 5,540,015 | A | 7/1996 | Anthony | | |
| 5,711,117 | A * | 1/1998 | Zaccagni | E04D 13/158 | 52/518 |
| 5,735,084 | A * | 4/1998 | Zaccagni | E04D 13/064 | 52/11 |
| 5,836,113 | A | 11/1998 | Bachman | | |
| 7,487,623 | B2 | 2/2009 | Rodolofo et al. | | |

FOREIGN PATENT DOCUMENTS

| | | | | |
|---|---|---|---|---|
| AU | 676104 B2 | 2/1997 | | |
| CA | 2202567 A1 | 10/1997 | | |
| FR | 2922922 A1 * | 5/2009 | E04D 13/158 | |
| GB | 1587461 A * | 4/1981 | E04D 13/158 | |
| GB | 0360465 A1 * | 3/1990 | | |
| GB | 2306979 A * | 5/1997 | E04D 13/152 | |
| WO | WO-2006078235 A1 * | 7/2006 | E04D 13/158 | |

* cited by examiner

*Primary Examiner* — Adriana Figueroa
(74) *Attorney, Agent, or Firm* — Larson & Larson; Frank Liebenow

(57) ABSTRACT

A system for securing an end of a soffit panel to a structure includes an F-channel that is affixed to the structure. The F-channel includes a mechanism for locking an end of the soffit panel that has an upper hook and a lower hook such that after inserting the end of the soffit panel into the mechanism for locking, the upper hook and the lower hook locks the end of the soffit panel within the F-channel.

20 Claims, 15 Drawing Sheets

LOCKING SOFFIT

BACKGROUND OF THE INVENTION

A soffit provides attic ventilation for homes and other structures, as well as a clean and neat surface beneath roof eaves and edges. The soffit covers the underside of a roof where it extends beyond the walls of a building and, therefore, the soffit covers a portion of an opening to an attic of the building. As heat builds up inside the attic, cooler air enters the attic through the soffit. Various types of vinyl or aluminum soffit panels and installation fixtures are regularly used, especially for wood-framed homes and structures.

The current art for installing a soffit utilizes channels such as J-channels, F-channels, and L-channels to secure the soffit panel between the facia and the wall of the home or building. As the soffit panels are typically made from various types of vinyl or aluminum, the soffit panels are somewhat flexible and resilient. This flexibility and resiliency are useful in installing the soffit panels between channels in the facia and wall as the soffit panel is often flexed to insert into the channels. Furthermore, the soffit panels are often formed or cut to a width that is slightly less than the distance between the inner edges of the channels to allow for uneven walls, uneven facia, or other tolerances.

The current art works well for installation and during most situations, but when there is an extreme pressure difference between air in the attic and external air, there is significant air pressure and, therefore, air flow either into or out of the attic, going through the soffit. This significant air flow causes the soffit panels to flex and, if the soffit panels flex enough, the soffit panels disengage from one or both of the channels and the soffit panels usually fall to the ground. In such cases, if the soffit panel is not damaged and has not blown away, the soffit panel can be reinserted between the channels, but often this requires an installer and a ladder at considerable costs. Such loss of soffit panels happens often in sever weather such as hurricanes, straight-line winds, tornadoes, etc.

What is needed is a system that will keep the soffit panel in place during most air flow conditions.

SUMMARY OF THE INVENTION

In one embodiment, a system for securing the end of a soffit panel to a structure is disclosed. The system includes a channel for affixing to the structure (e.g., with adhesives, screws, nails). The channel has a locking mechanism. An end of the soffit panel has a barb/hook mechanism such that after inserting the barb/hook mechanism into the locking mechanism, the barb/hook mechanism and the locking mechanism hold that end of the soffit panel within the channel. The barb/hook mechanism is anticipated to be inwardly facing, or a pointed barb.

In another embodiment, a system for securing an end of a soffit panel to a structure is disclosed. The system includes a channel (e.g., an F-channel, U-channel, wall channel, track, wall track) that is affixed to the structure. The channel includes a mechanism for locking an end of the soffit panel that has an upper hook and a lower hook such that after inserting the end of the soffit panel into the mechanism for locking, the upper hook and the lower hook locks the end of the soffit panel within the channel.

In another embodiment, a soffit panel is disclosed. The soffit panel has alternating, offset upper surfaces and lower surfaces. The soffit panel has a first lengthwise end for affixing to a facia of a roof system and a second lengthwise end for insertion into a channel (e.g., an F-channel, U-channel, wall channel, track, wall track), the second lengthwise end has an upper edge that includes upper hooks for locking into the channel after the second lengthwise edge is inserted into the F-channel.

In another embodiment, a soffit system is disclosed. The soffit system includes a channel (e.g., an F-channel, U-channel, wall channel, track, wall track) for affixing to a structure. The channel has a base, a first leg, and a second leg. A first end of the first leg connects to the base at approximately 90 degrees and a first end of the second leg connects to the base at approximately 90 degrees. A second distal end of the first leg has a first catch and a second distal end of the second leg has a second catch. The first catch is on a side of the first leg that is towards the second leg and the second catch is on a side of the second leg that is towards the first leg. The soffit system includes a soffit panel that has a first lengthwise side and a second lengthwise side. The first lengthwise side has an upper hook and a lower hook for inserting the first lengthwise side into the channel between the first catch and the second catch, thereby locking the upper hook by the first catch and the lower hook by the second catch.

BRIEF DESCRIPTION OF DRAWINGS

The invention can be best understood by those having ordinary skill in the art by reference to the following detailed description when considered in conjunction with the accompanying drawings in which.

DETAILED DESCRIPTION OF THE INVENTION

Figure 1:
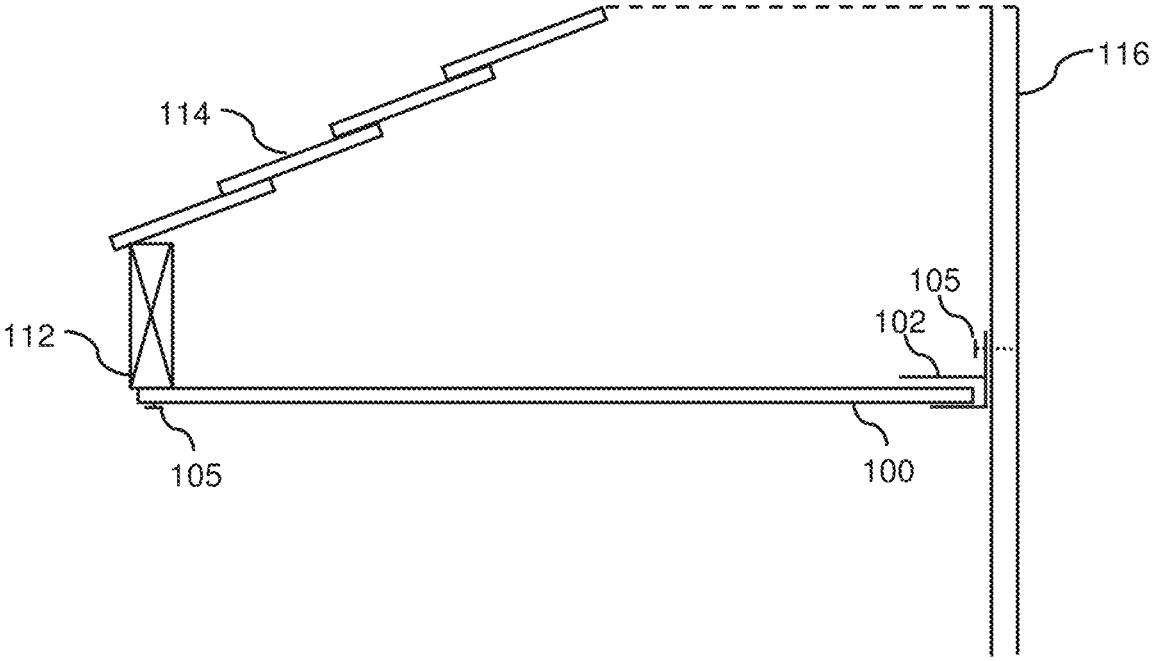
FIG. 1 (Prior Art)
FIG. 1 illustrates a schematic view of a soffit installed to a building as per the prior art.

Reference will now be made in detail to the presently preferred embodiments of the invention, examples of which are illustrated in the accompanying drawings. Throughout the following detailed description, the same reference numerals refer to the same elements in all figures.

Throughout this description, certain portions of the building such as the drip-edge, fascia, and wall construction are omitted for brevity and clarity reasons.

Referring to FIG. 1, a schematic view of a prior soffit panel 100 installed to a building as per the prior art is shown. In the prior art, each prior soffit panel 100 is installed at one end into a channel 102 and affixed to a board 112 of the fascia at the other end, for example, using a nail 105. The channel 102 is affixed to the wall 116, typically using fasteners such as screws or nails 105. Although shown as F-channels in the drawings, there are many forms of channels in the prior art such as J-channels, F-channels, and L-channels, U-channels, wall cannels, tracks, wall tracks.

In FIG. 1, a portion of a roof 114 is also shown. Note that the prior soffit panel 100 is typically made of aluminum or a plastic such as vinyl and, being made of such, is stiff, yet bendable and resilient enough to bend for insertion into the channel 102. Also note that the prior soffit panels 100 are typically cut shorter than the distance between the wall 116 and the board 112 of the facia to account for uneven walls 116 and boards 112.

In some embodiments, holes (not shown for brevity and clarity reasons) are formed along one edge of the prior soffit panels 100 of the prior art (not shown for brevity and clarity reasons) and the nails 105 are hammered through the holes to fasten the prior soffit panel 100 to the board 112 of the facia. As the prior soffit panel 100 is typically made of sheet aluminum or vinyl, often with the day-to-day flexing caused by normal air flow, the prior soffit panel 100 weakens at these nail interfaces.

Figure 2:
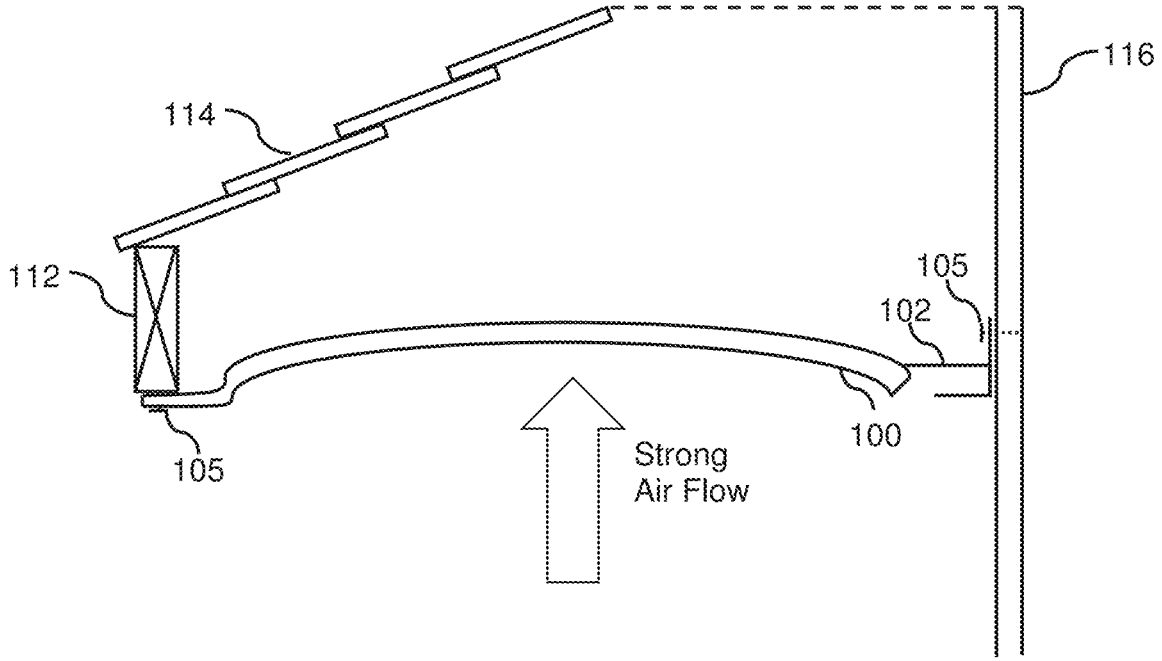
FIG. 2 (Prior Art)
FIG. 2 illustrates a schematic view of a soffit installed to a building as per the prior art showing the effects of high-pressure gradients or wind.

Referring to FIG. 2, a schematic view of a prior soffit installed to a building as per the prior art showing the effects of high-pressure gradients or wind is shown. In this view, the same prior soffit panel 100 was installed at one end into the channel 102 and affixed to the board 112 of the facia at the other end using, for example, a nail 105; the channel 102 affixed to the building. A pressure different between the attic are and the ambient air has caused a strong air flow into the attic from the ambient air causing the prior soffit panel 100 to flex or bend so much that the end of the prior soffit panel 100 has left the channel 102 and, in this example, the prior soffit panel 100 will move into the attic space and, once the strong air flow abates, the prior soffit panel 100 will likely fall to the ground or blow away if it is windy as the prior soffit panel 100 is often very weak around where the nail 105 is placed.

Figure 3:
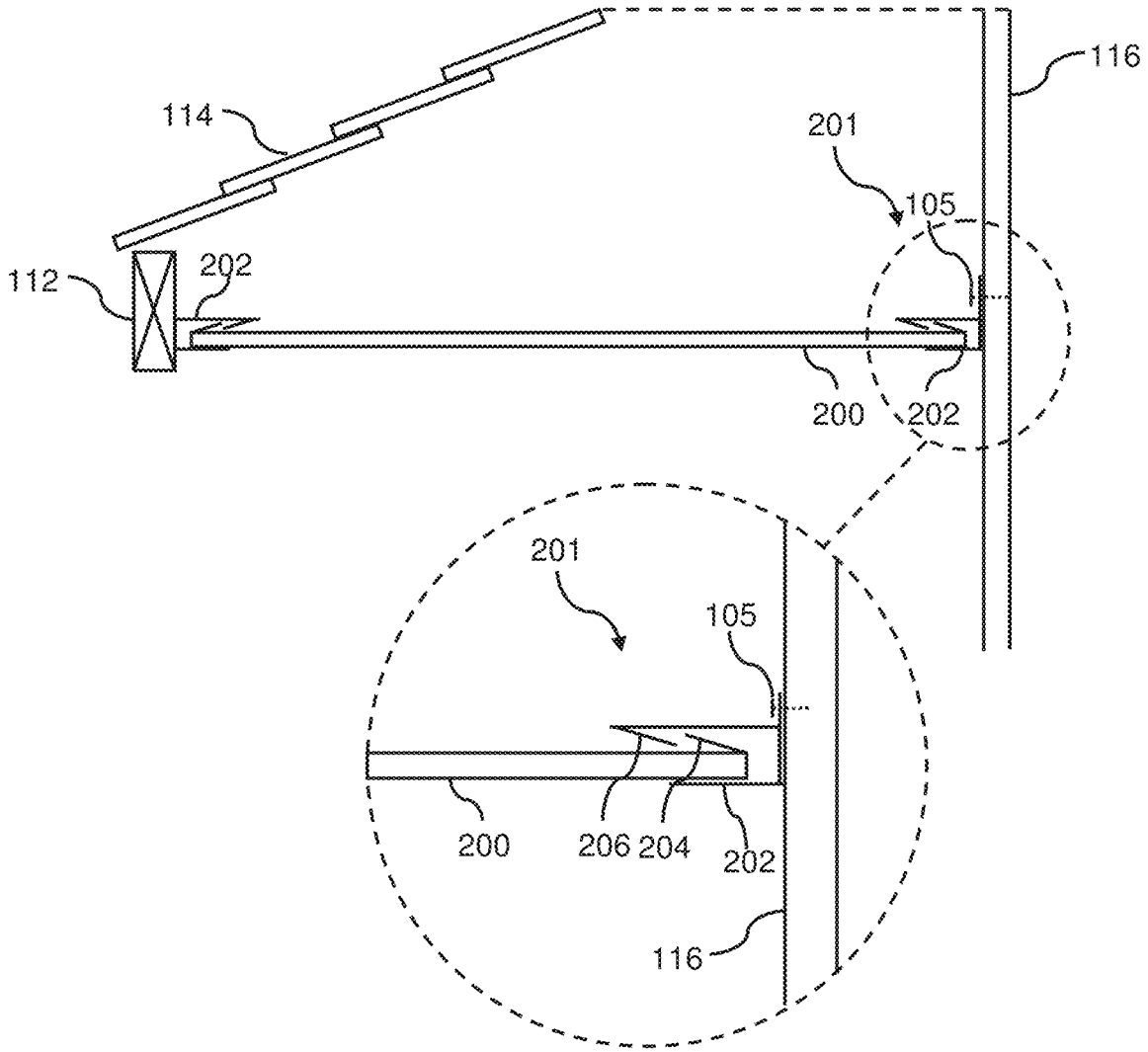
FIGS. 3 and 3A illustrate schematic views of a first mode of soffit installed to a building as per the present invention.
Figure 3A:
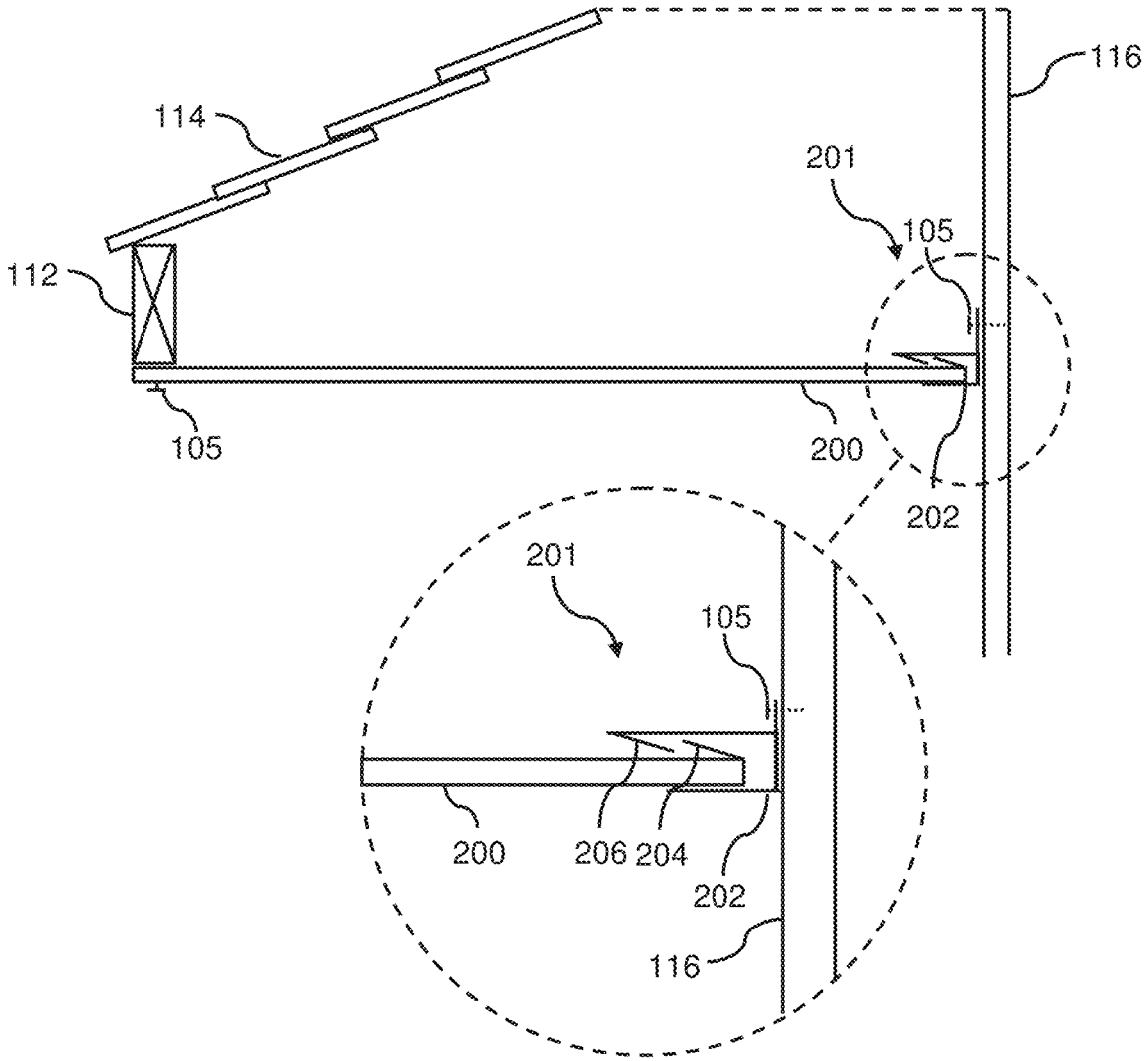
Figure 5:
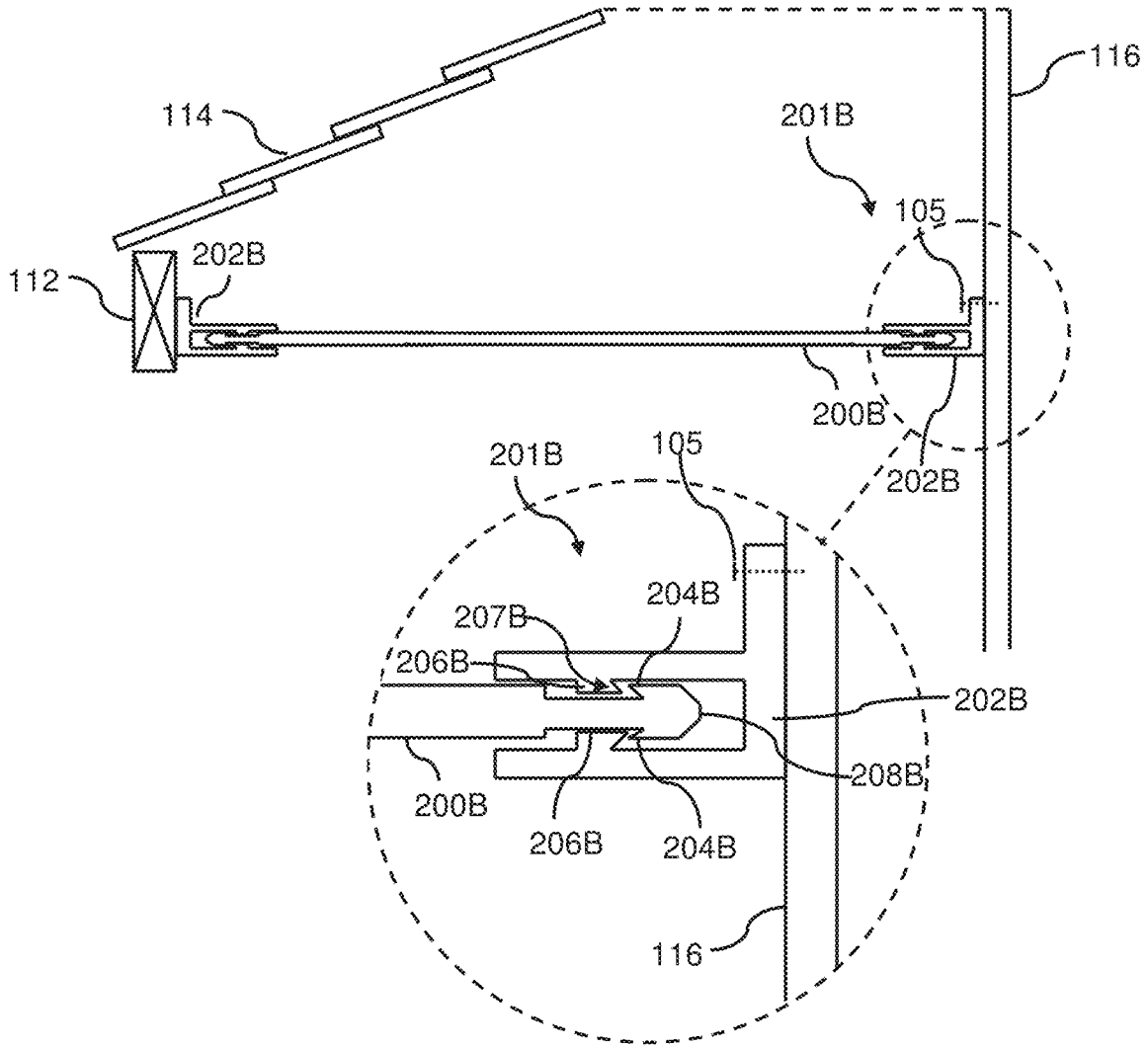
FIGS. 5 and 5A illustrate schematic views of a third mode of soffit installed to a building as per the present invention.

Referring to FIGS. 3 and 3A, schematic views of a soffit panel 200 having a locking mechanism 201 are shown installed to a building as per the present invention. In some embodiments, the soffit panel 200 is installed between two locking channels 202 (as shown in FIG. 3) or in some embodiments the soffit panel 200 is installed between one locking channel 202 and affixed to the board 112 of the facia at an opposite end using, for example, a nail 105 as shown in FIG. 3A. In the example of FIG. 5, one locking channel 202 is affixed to the board 112 of the facia and the other locking channel 202 is affixed to the wall 116 of the building, typically using fasteners such as screws or nails. Each locking channel 202 has an inwardly aimed barb 206 (e.g. an inwardly aimed barb 206 that is formed or attached at an end of the locking channel 202 and opens toward the surface to which the locking channel 202 is affixed (e.g., board 112 or wall 116). The soffit panel 200 has a barb 204 at one or both ends. The barb 204 is formed or affixed to an end area of the soffit panel 200 and opening towards the opposing end of the soffit panel 200. As the soffit panel 200 and/or the locking channel 202 are made from metal (e.g., aluminum, galvanized steel, galvalume) or plastic (e.g., vinyl), the inwardly aimed barb 206 and/or the barb 204 on the soffit panel 200 are resilient. Therefore, as the end of the soffit panel 200 is inserted into the locking channel 202, one or both of the inwardly aimed barb 206 and/or the barb 204 on the soffit panel 200 bend, allowing for insertion. Once the barb 204 on the soffit panel 200 passes the inwardly aimed barb 206, one or both of the inwardly aimed barb 206 and/or the barb 204 on the soffit panel 200 return to substantially their original shape as shown in FIG. 3. When a strong air flow occurs (as in FIG. 2), the inwardly aimed barb 206 catches on to the barb 204 on the soffit panel 200, resisting release of the soffit panel 200 from the locking channel 202. Note that in embodiments in which a single locking channel 202 is utilized (e.g., a nail 105 is used at one end of the soffit panel 200 as in FIG. 3A), it is anticipated that during strong air flows, the end of the soffit panel 200 that is held by the nail 105 may come free from the nail 105, but the opposite end of the soffit panel 200 will remain in the locking channel 202 and not blow away or fall and possibly hurt somebody. Note that the loss of a prior soffit panel 100 during a storm allows water entry into the attic of the building.

For completeness, a portion of a roof 114 is also shown. Note that the soffit panel 200 is typically made of metal (e.g., aluminum, galvanized steel, galvalume) or plastic (e.g., vinyl) and, being made of such, is stiff, yet bendable and resilient enough to bend for insertion between the locking channels 202 or between a locking channel 202 and a channel 102 of the prior art. Also note that the soffit panels 200 are typically cut shorter than the distance between the wall 116 and the board 112 to account for uneven walls 116 and board 112.

Figure 4:
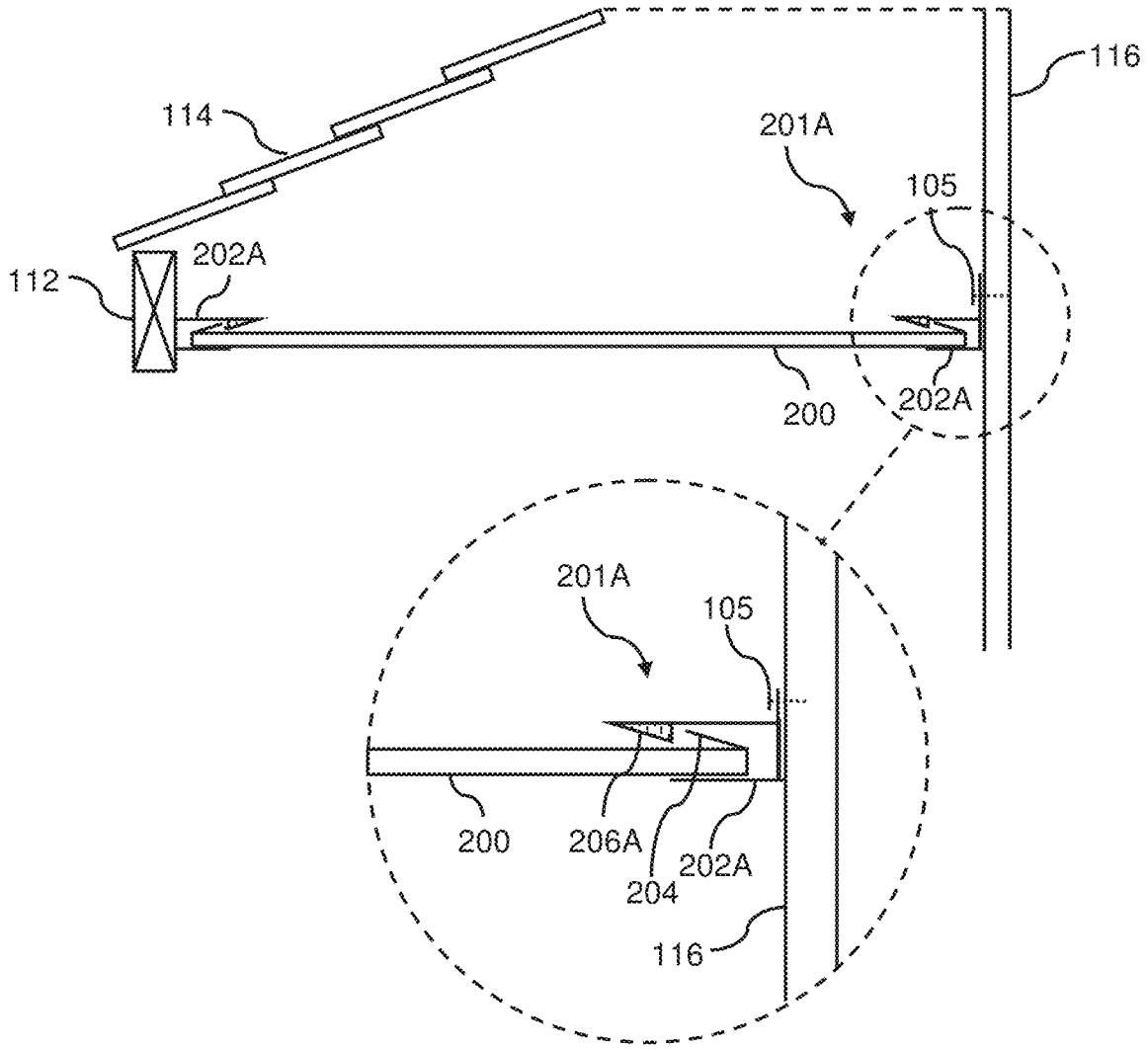
FIGS. 4 and 4A illustrate schematic views of a second mode of soffit installed to a building as per the present invention.
Figure 4A:
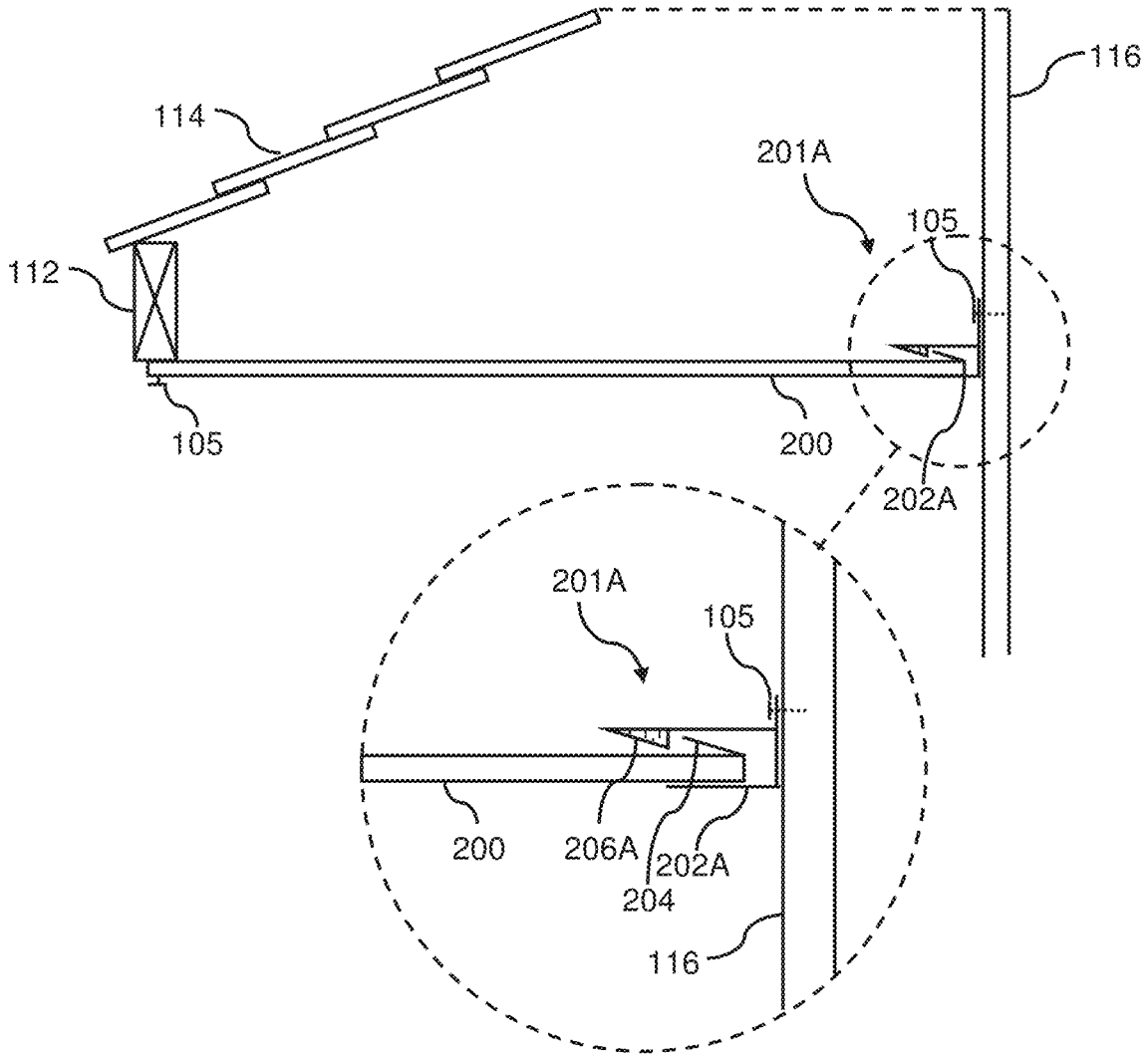

Referring to FIGS. 4 and 4A, schematic views of a soffit installed to a building as per the present invention using a locking mechanism 201A are shown. In one embodiment, as shown in FIG. 4, the soffit panel 200 is installed between two locking channels 202A while in some embodiments as shown in FIG. 4A, the soffit panel 200 is held at one end by a single locking channel 202A and the other end is affixed to the board 112 (e.g., by a nail 105). In the embodiment of FIG. 5, one locking channel 202A is affixed to the board 112 of the facia and the other locking channel 202A is affixed to the wall 116 of the building, typically using fasteners such as screws or nails. Each locking channel 202A has an inwardly aiming step 206A (e.g. an inwardly aiming step 206A that is formed or attached at an end of the locking channel 202A and increases in width toward the surface (e.g., board 112 or wall 116) to which the locking channel 202A is affixed. The soffit panel 200 has a barb 204 at one or both ends, formed or affixed to an end area of the soffit panel 200 and opening towards the opposing end of the soffit panel 200. As the soffit panel 200 and/or the locking channel 202A are made using metal (e.g., aluminum, galvanized steel, galvalume) or plastic (e.g., vinyl), the inwardly aiming step 206A and/or the barb 204 on the soffit panel 200 are resilient. Therefore, as the end of the soffit panel 200 is inserted into the locking channel 202A, one or both of the inwardly aiming step 206A and/or the barb 204 on the soffit panel 200 will bend or deform, allowing for insertion. Once the barb 204 on the soffit panel 200 passes the inwardly aiming step 206A, one or both of the inwardly aiming step 206A and/or the barb 204 on the soffit panel 200 return to substantially their original shape as shown in FIG. 4. When a strong air flow occurs (as in FIG. 2), the barb 204 catches on to the inwardly aiming step 206A, resisting release of the soffit panel 200 from the locking channel 202A. Note that in embodiments in which a single locking channel 202A is utilized (e.g., a nail 105 is used to secure one end of the soffit panel 200 to the board 112 of the facia), it is anticipated that during strong air flows, the end of the soffit panel 200 that is nailed to the board 112 might fail, but the soffit panel 200 will remain in the locking channel 202A and not blow away or fall and possibly hurt somebody.

For completeness, a portion of a roof 114 is also shown. Note that the soffit panel 200 is typically made of metal (e.g., aluminum, galvanized steel, galvalume) or plastic (e.g., vinyl), and, being made of such, is stiff, yet bendable and resilient enough to bend for insertion between the locking channels 202A or between a locking channel 202A and a channel 102 of the prior art. Also note that the soffit panels 200 are typically cut shorter than the distance between the wall 116 and the board 112 to account for uneven walls 116 and board 112.

Figure 5A:
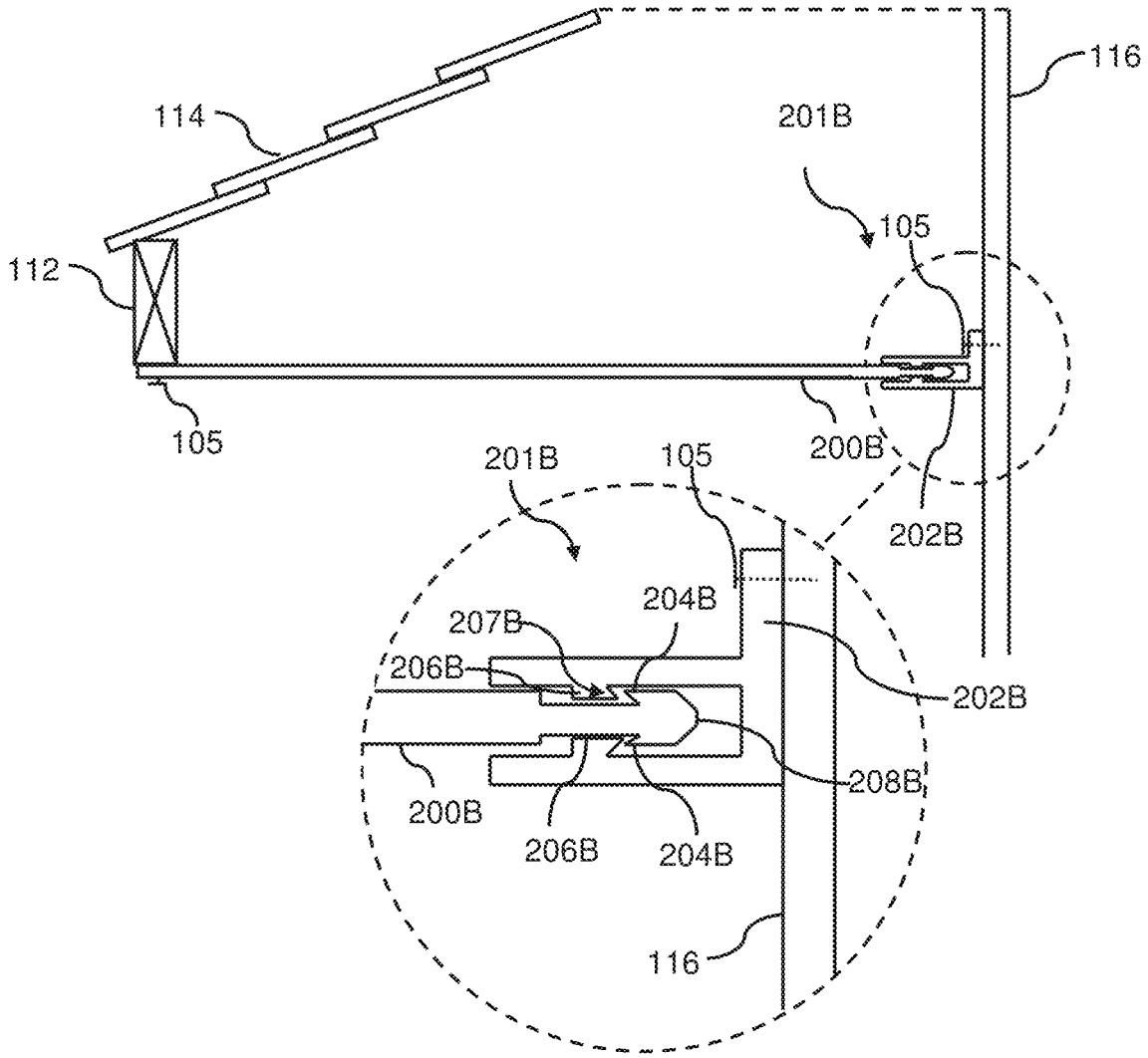

Referring to FIGS. 5 and 5A, schematic views of a soffit panel 200B having a locking mechanism 201B is shown installed to a building as per the present invention. In some embodiments, as shown in FIG. 5, the soffit panel 200B is installed between two locking channels 202B while in some embodiments, the soffit panel 200B is installed using a locking channel 202B at one end (e.g., at the wall 116 of the building) and affixed to the board 112 of the facia at the other end (e.g., using nails 105). In the embodiment of FIG. 5, one locking channel 202B is affixed to the board 112 and the other locking channel 202B is affixed to the wall 116 of the building, typically using fasteners such as screws or nails. Each locking channel 202B has notched orifice 206B (e.g. formed or affixed to an inside surface of the locking channel 202B with a notch 207B). The soffit panel 200B has a pointed barb 208B at one or both ends, formed or affixed to an end area of the soffit panel 200B and pointing outwardly from the soffit panel 200. The pointed barb 208B has a catch edge 204B that is formed to catch on the notch 207B after insertion of the pointed barb 208B into the locking channel 202B.

As the soffit panel 200B and/or the locking channel 202B are made using metal (e.g., aluminum, galvanized steel, galvalume) or plastic (e.g., vinyl), the pointed barb 208B and/or the notched orifice 206B are resilient. Therefore, as the pointed barb 208B is inserted into the locking channel 202B, an angled edge 209B (see FIG. 6) of the pointed barb 208B on the soffit panel 200 causes the notched orifice 206B to bend or deform, allowing for insertion of the pointed barb 208B. Once the pointed barb 208B on the soffit panel 200 passes the notched orifice 206B, the notched orifice 206B returns to substantially its original shape as shown in FIG. 5. When a strong air flow occurs (as in FIG. 2), the pointed barb 208B catches on to the notch 207B, resisting release of the soffit panel 200B from the locking channel 202B. Note that in embodiments in which a single locking channel 202B is utilized (e.g., as in FIG. 5A, one end of the soffit panel is affixed to the board 112 using a nail 105), it is anticipated that during strong air flows, the end of the soffit panel that is affixed to the board 112 (e.g., using a nail 105), the connection may fail, but the soffit panel 200B will remain in the locking channel 202B and not blow away or fall and possibly hurt somebody.

For completeness, a portion of a roof 114 is also shown. Note that the soffit panel 200B is typically made of metal (e.g., aluminum, galvanized steel, galvalume) or plastic (e.g., vinyl), and, being made of such, is stiff, yet bendable and resilient enough to bend for insertion between the locking channels 202B or between a locking channel 202B and a channel 102 of the prior art. Also note that the soffit panels 200B are typically cut shorter than the distance between the wall 116 of the building and the inside surface of the board 112 to account for uneven walls 116 of the building and board 112.

Figure 6:
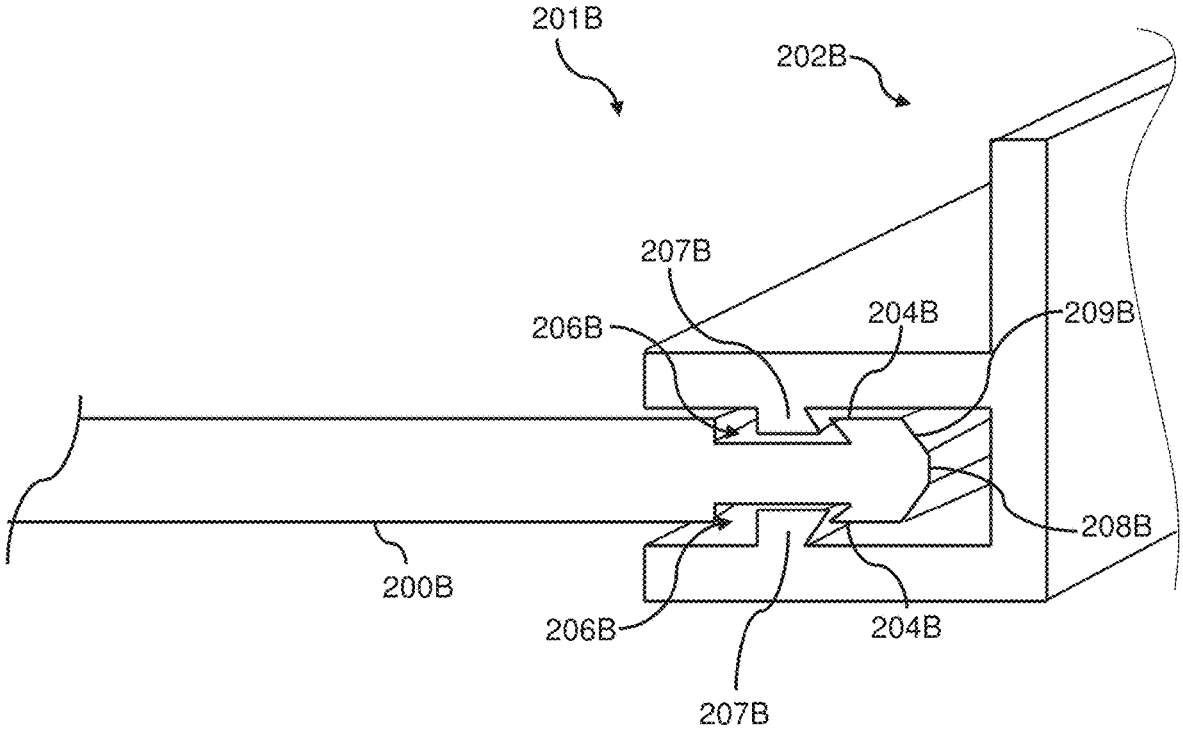
FIG. 6 illustrates a detailed perspective view of the soffit channel shown in FIG. 5.

Referring to FIG. 6, a detailed perspective view of one embodiment of the locking soffit channel 202B shown in FIG. 5. In some embodiments, the locking soffit channel 202B is fabricated as a single, elongated section, for example, extruded metal (e.g., aluminum, galvanized steel, galvalume) or plastic (e.g., vinyl).

Although the soffit panels 200/200B are shown with barbs 204 or pointed barbs 208B at both ends of the soffit panel 200/200B, it is equally anticipated that one end of the soffit panels 200/200B have no locking mechanism for interfacing with a channel 102 or other mounting mechanism such as using a nail 105. Further, it is fully anticipated that any combination of locking mechanisms be provided on each soffit panel 200/200B.

Figure 7:
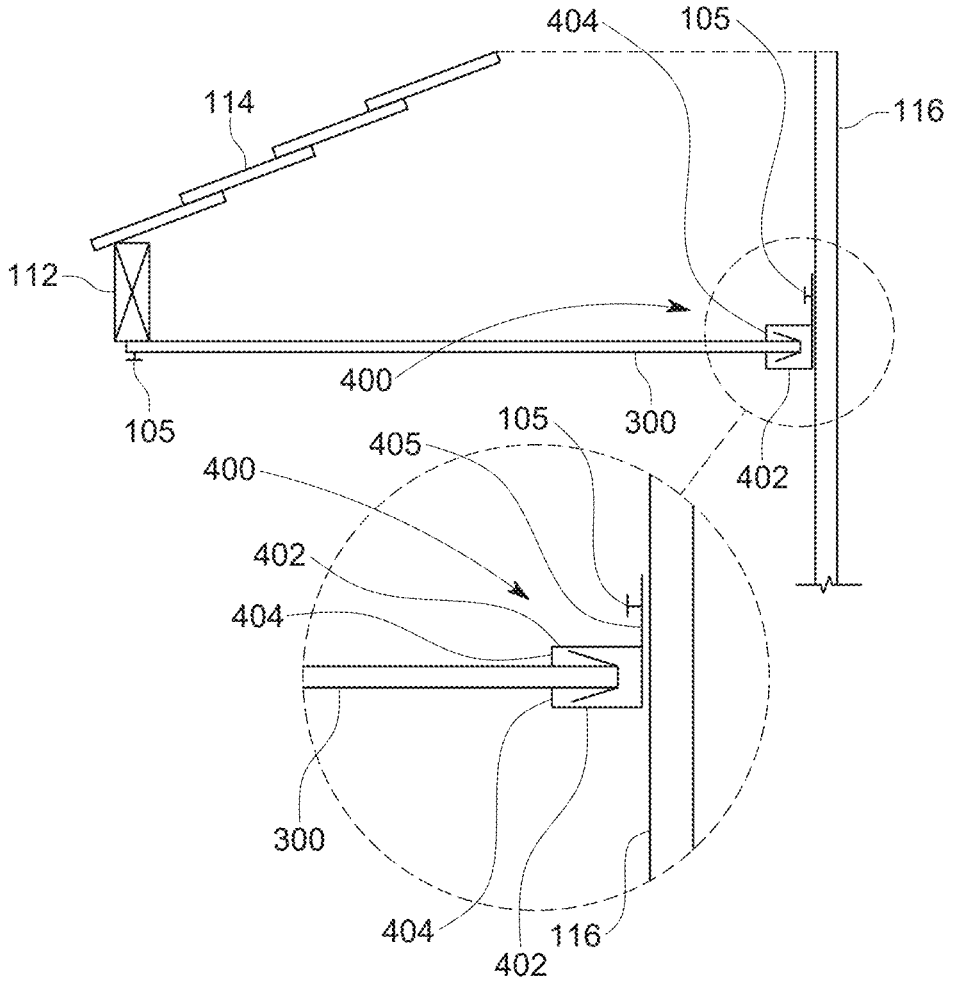
FIG. 7 illustrates a schematic view of a fourth mode of the soffit installed to a building as per the present invention.

Referring to FIG. 7, a schematic view of a fourth mode of soffit installed onto a building as per the present invention is shown. In the embodiment shown, the soffit panel 300 is installed into a locking F-channel 400 and affixed to the board 112 of the facia at the other end of the soffit panel 300 (e.g., using fasteners such as nails 105). Note that although an F-channel 400 is shown, any form/shape of channel (e.g., an F-channel, U-channel, wall channel, track, wall track) is fully anticipated.

Figure 8:
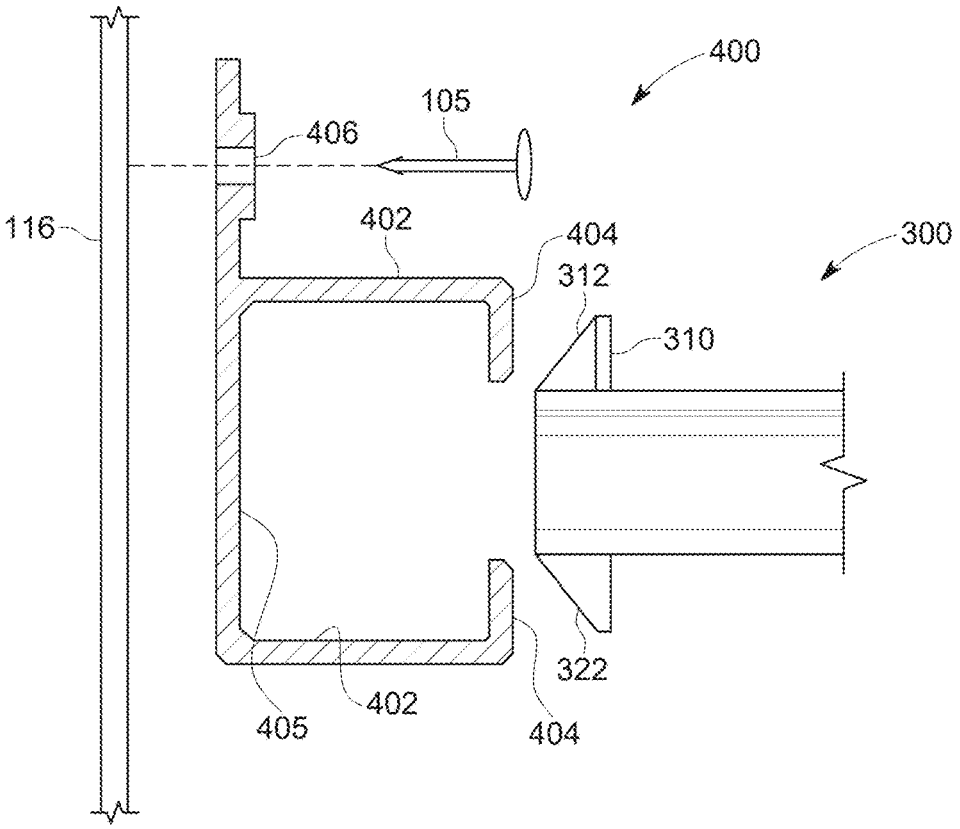
FIG. 8 illustrates a detailed perspective view of the soffit channel shown in FIG. 7 before insertion of the soffit.

The locking F-channel 400 is affixed to the wall 116 of the building, typically using fasteners such as screws or nails 105. Each locking F-channel 400 has a base 405 that has at least one orifice 406 (see FIGS. 8 and 8A) through which the fastener or nail 105 passes for holding the locking F-channel 400 to the wall 116. The locking F-channel 400 has two legs 402 that extend perpendicularly (90 degrees) or approximately perpendicularly (approximately 90 degrees) at a first end from the base 405 to form an "F" shape. At the other end of each leg 402 is a catch 404 that captures the hooks 312/322 of the soffit panel 300 (shown captured in FIG. 7). Once the hooks 312/322 of the soffit panel 300 enter the locking F-Channel 400, it is difficult for the soffit panel 300 to exit the locking F-channel 400, thereby resisting from being dislodged during strong winds.

As the soffit panel 300 and/or the locking F-channel 400 are made using metal (e.g., aluminum, galvanized steel, galvalume) or plastic (e.g., vinyl, polyvinyl chloride). The legs 402 are resilient to allow the legs 402 and catches 404 to spread apart during insertion of the soffit panel 300, then closing back to lock the hooks 312/322 of the soffit panel 300 behind the catches 404. Therefore, as the hooks 312/322 are inserted into the locking F-channel 400, the barbs 312/322 on the soffit panel 300 causes the legs 402 and catches 404 to bend or deform, allowing for insertion of the hooks 312/322. Once the hooks 312/322 on the soffit panel 300 pass the catches 404, the legs 402 and catches 404 return to substantially their original shape as shown in FIG. 7. When a strong air flow occurs (as in FIG. 2), the hooks 312/322 cannot easily escape the catches 404, resisting release of the soffit panel 300 from the locking F-channel 400. Note that it is anticipated that during strong air flows, the end of the soffit panel that is affixed to the board 112 (e.g., using a nail 105) may fail and come loose, but the soffit panel 300 will likely remain in the locking F-channel 400 and not blow away or fall and possibly hurt somebody.

For completeness, a portion of a roof 114 is also shown. Note that the soffit panel 300 and the locking F-channel is typically made of metal (e.g., aluminum, galvanized steel, galvalume) or plastic (e.g., vinyl, polyvinyl chloride).

Figure 8A:
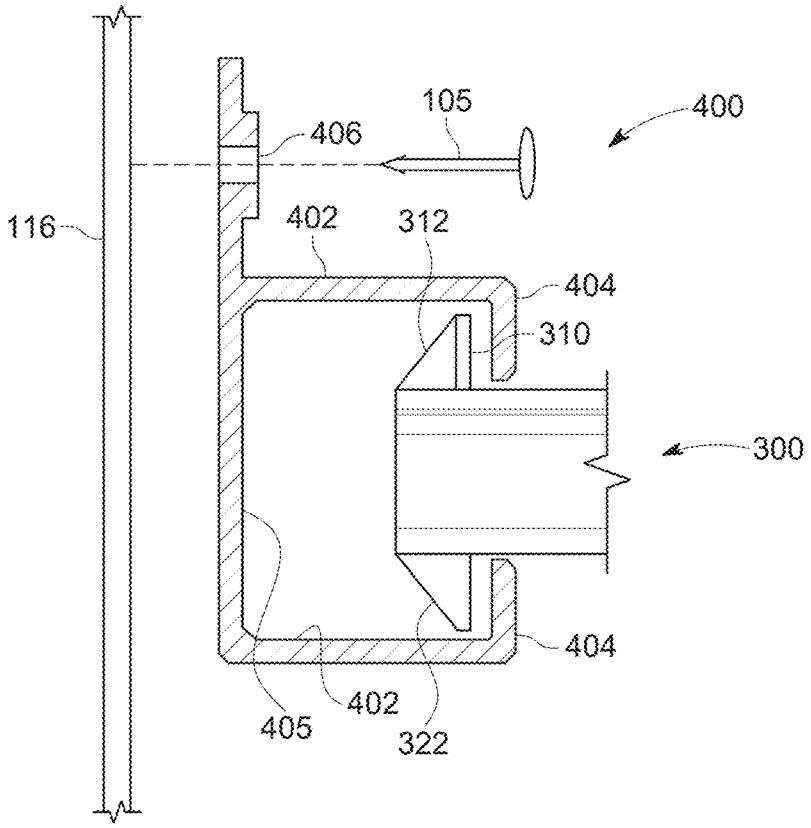
FIG. 8A illustrates a detailed perspective view of the soffit channel shown in FIG. 7 after insertion of the soffit.

Referring to FIGS. 8 and 8A, detailed perspective views of the locking F-channel 400 of FIG. 7 are shown before insertion of the soffit panel 300 (FIG. 8) and after insertion of the soffit panel 300 (FIG. 8A). A side cut-away view of the locking F-channel 400 is shown. Typically, the locking F-channel 400 is affixed to the wall 116 before insertion of the soffit panel 300. In such, the locking F-channel 400 is held to the wall 116 by a fastener or nail 105 that passes through an orifice 406 in the base 405 of the locking F-channel 400 and into the wall 116, though any mounting scheme is anticipated including the use of an adhesive or double-sided tape.

As described, the locking F-channel 400 has two legs 402 that extend perpendicularly or approximately perpendicularly at a first end from the base 405 to form an "F" shape. At the other end of each leg 402 is a catch 404 that captures the barbs 312/322 of the soffit panel 300 (shown captured in FIGS. 7 and 8A). Once the hooks 312/322 of the soffit panel 300 enter the locking F-Channel 400, it is difficult for the soffit panel 300 to exit the locking F-channel 400, thereby resisting from being dislodged during strong winds.

As the soffit panel 300 and/or the locking F-channel 400 are made using metal (e.g., aluminum, galvanized steel, galvalume) or plastic (e.g., vinyl, polyvinyl chloride). The legs 402 are resilient to allow the legs 402 to spread apart during insertion of the soffit panel 300, then closing back to lock the hooks 312/322 of the soffit panel 300 behind the catches 404. Therefore, as the hooks 312/322 are inserted into the locking F-channel 400, the hooks 312/322 on the soffit panel 300 causes the legs 402 and catches 404 to bend or deform, allowing for insertion of the hooks 312/322. Once the hooks 312/322 on the soffit panel 300 pass the catches 404, the legs 402 and catches 404 return to substantially their original shape as shown in FIGS. 7 and 8A. When a strong air flow occurs (as in FIG. 2), the hooks 312/322 cannot easily escape the catches 404, resisting release of the soffit panel 300 from the locking F-channel 400.

Figure 9:
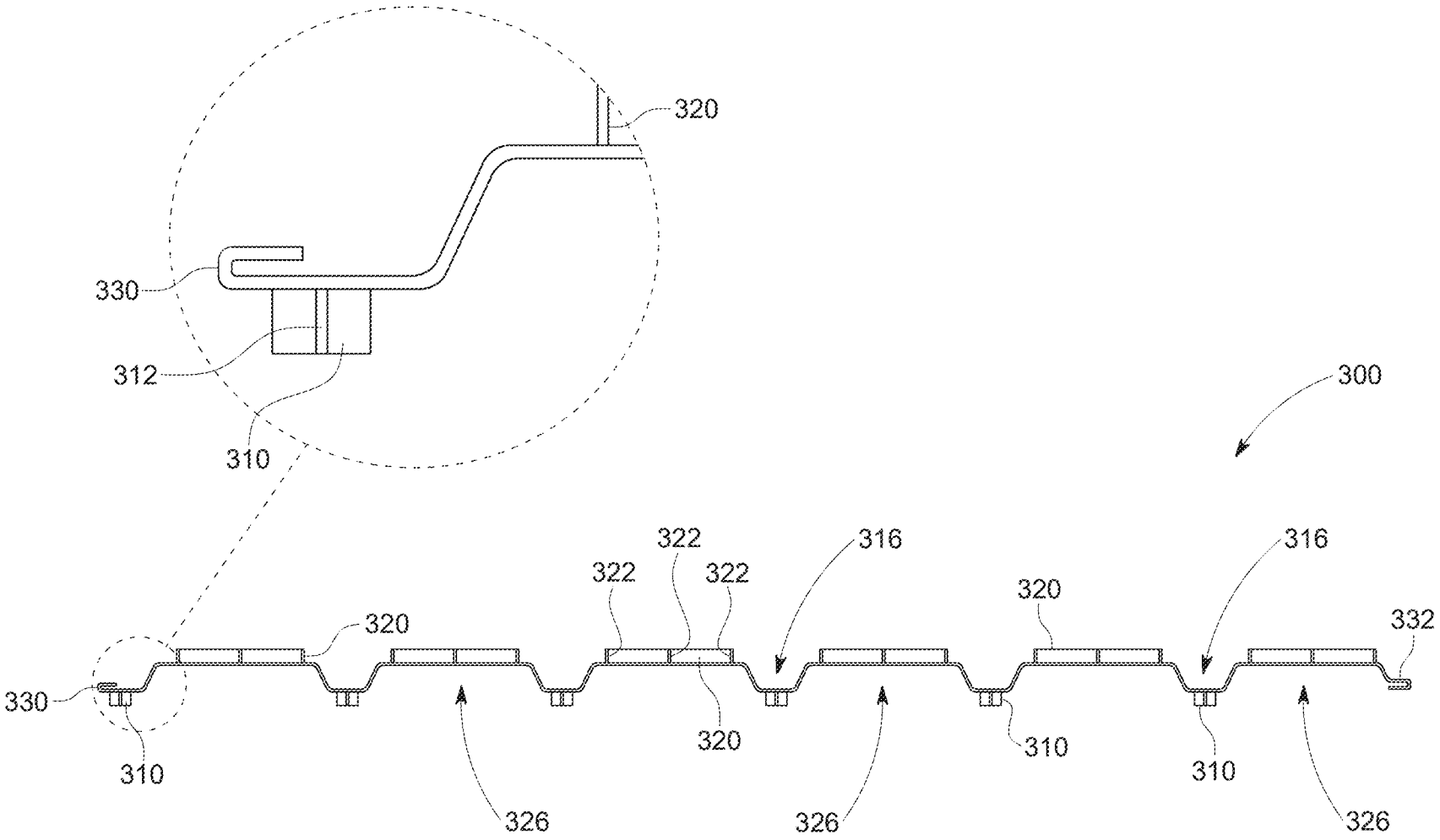
FIG. 9 illustrates a side plan view of the fourth mode of soffit installed to a building as per the present invention.

Referring to FIGS. 9, 10, 11, and 12 views of the fourth mode of soffit panel 300 as per the present invention are shown. In FIG. 9, the front of the upper hook 310 is shown with upper angled steps 312. Note that upper direction is generally the direction of the upper surface 316 of the soffit panel 300 when installed horizontally between a building and a facia board, though any configuration of installation is anticipated. Although three upper angled steps 312 are shown for each upper hook 310, any number of upper angled steps 312 are anticipated, including one upper angled step 312 that is partially or the full length of the upper hook 310. The upper angled steps 312 engage with one of the catches 404 of the locking F-channel 400 to displace that leg 402 and catch 404 of the locking F-channel 400 as the soffit panel 300 is inserted into the locking F-channel 400. After the upper angled steps 312 pass into the locking F-channel 400 (beyond the catch 404), the leg 402/catch 404 returns to approximately that leg 402/catch 404 original shape, locking the upper hook 310 against the catch 404.

In FIG. 9, the front of the lower hook 320 is shown with lower angled steps 322. Although one lower angled step 322 is shown for each lower hook 320, any number of lower angled steps 322 are anticipated, including one lower angled step 322 that is partially or the full length of the lower hook 320. The lower angled step 322 engages with the other leg 402 and catch 404 of the locking F-channel 400 to displace that leg 402 and catch 404 of the locking F-channel 400 as the soffit panel 300 is inserted into the locking F-channel 400. After the lower angled steps 322 pass into the locking F-channel 400 (beyond the catch 404), the leg 402 and catch 404 return to approximately that leg 402 and catch 404 original shape, locking the lower hook 320 against the catch 404.

In some embodiments, for rigidity, the soffit panel 300 has an upper surface 316 that is offset from a lower surface 326. In some embodiments, one or both of the upper surface 316 and lower surface 326 includes a plurality of orifices while in some embodiments, the upper surface 316 and the lower surface 326 are solid without orifices.

At each end of the soffit panel 300 is a set of hooks 330/332. During installation, the left hook 330 of the hooks 330/332 of a first soffit panel 300 is interfaced to a right hook 332 of the hooks 330/332 of an adjacent soffit panel 300 to hold the first soffit panel 300 to the adjacent soffit panel, etc.

Figure 10:
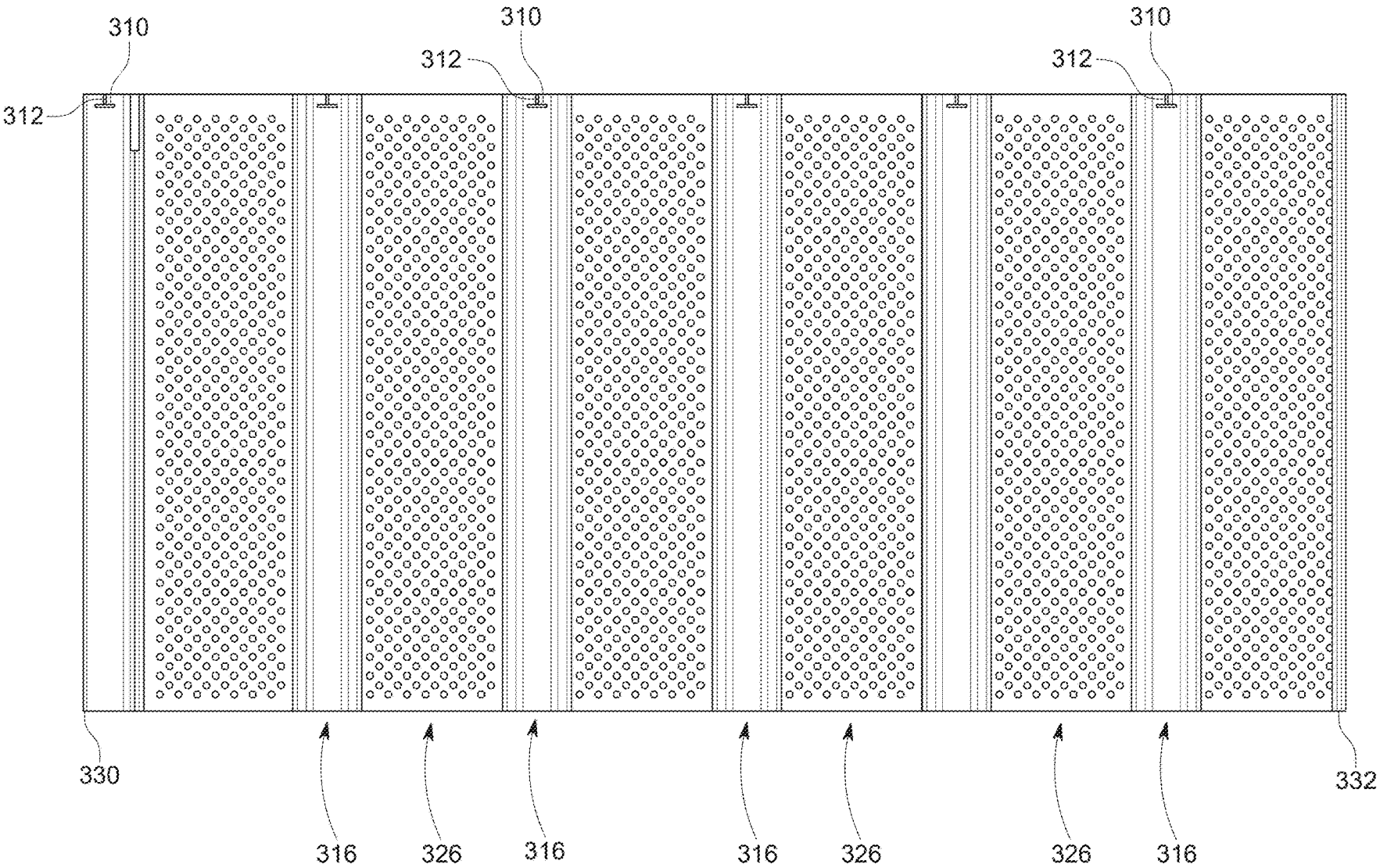
FIG. 10 illustrates a top plan view of the fourth mode of soffit as per the present invention.

In FIG. 10, the surface of the upper surface 316 and lower surface 326 is shown. Note that the lower surface 326 is shown having air vent holes, though in some embodiments, the soffit panel is without air vent holes or having air vent holes in the upper surface 316.

Figure 11:
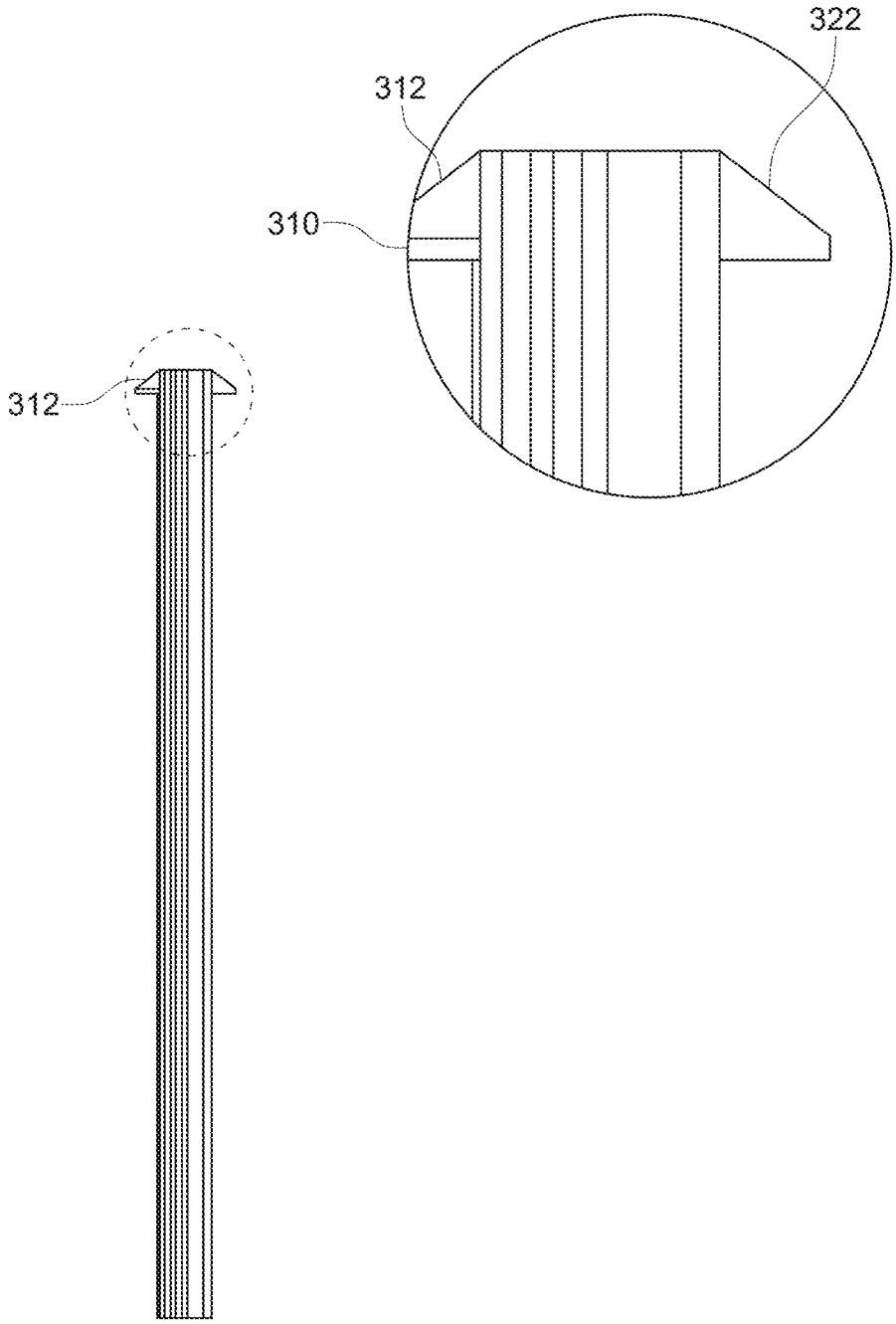
FIG. 11 illustrates an edge plan view of the fourth mode of soffit as per the present invention.

In FIG. 11, an edge view is shown. Note that the upper hook 310 is shown with upper angled steps 312 as the upper angled step 312 is set back from the edge of the upper hook 310 as shown in FIG. 9, yet the lower hook 320 appears solid as the lower angled step 322 is shown at the end of the lower hook 320.

Figure 12:
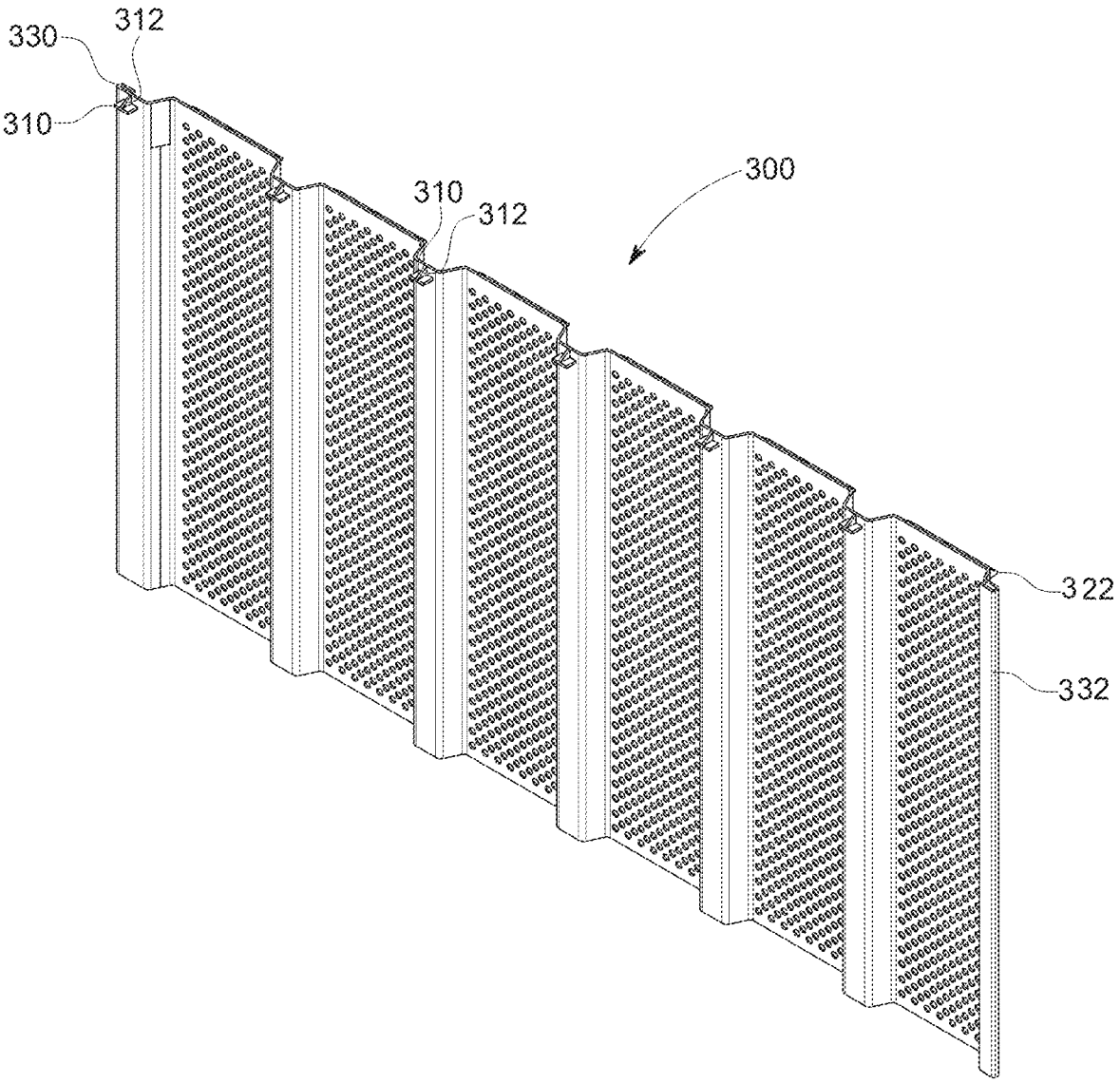
FIG. 12 illustrates a top perspective view of the fourth mode of soffit as per the present invention.

A perspective view of the soffit panel 300 is shown in FIG. 12. The upper hooks 310 and upper angled steps 312 are shown and only part of the lower angled steps 322 are visible in this view.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction, and arrangement of the components thereof without departing from the scope and spirit of the invention or without sacrificing all of its material advantages. The form herein before described being merely exemplary and explanatory embodiment thereof. It is the intention of the following claims to encompass and include such changes.

The invention claimed is:

1. A system for securing an end of a soffit panel to a wall of a structure, the system comprising:

a channel that is affixed to the wall of the structure, the channel having means for locking;

the end of the soffit panel having an upper hook and a lower hook such that after inserting the end of the soffit panel into the means for locking, the means for locking enters the upper hook, thereby locking the end of the soffit panel within the channel; and whereas the upper hook comprises an upper angled step such that when the end of the soffit panel is inserted into the means for locking, the upper angled step displaces the means for locking until the upper hook enters the means for locking.

2. The system for securing the end of the soffit panel to the wall of the structure of claim 1, whereas the channel comprises a base, the base has an orifice for accepting a fastener when the channel is affixed to the wall.

3. The system for securing the end of the soffit panel to the wall of the structure of claim 2, whereas the means for locking comprises a first leg that has a first catch and a second leg that has a second catch, the first leg extends from the base at an approximately 90 degree angle and the second leg extends from the base at the approximately 90 degree angle such that the first catch faces the second catch, the lower hook comprises a lower angled step such that when the end of the soffit panel is inserted into the means for locking, the upper angled step and the lower angled step displace the means for locking until the upper hook and the lower hook enter the means for locking.

4. The system for securing the end of the soffit panel to the wall of the structure of claim 3, whereas the first catch extends from the first leg at the approximately 90 degree angle and the second catch extends from the second leg at the approximately 90 degree angle, and the first catch is positioned towards the second catch and spaced apart from the second catch.

5. The system for securing the end of the soffit panel to the wall of the structure of claim 1, wherein the soffit panel and/or the channel comprise aluminum.

6. The system for securing the end of the soffit panel to the wall of the structure of claim 1, wherein the soffit panel and/or the channel comprise plastic.

7. The system for securing the end of the soffit panel to the wall of the structure of claim 6, wherein the plastic is vinyl.

8. A soffit panel, the soffit panel comprising:

the soffit panel has alternating, offset upper surfaces and lower surfaces;

the soffit panel has a first lengthwise end for affixing to a facia of a roof system and a second lengthwise end for insertion into a channel, the channel comprising two legs connected to a base, at least one of the two legs having a protrusion, the second lengthwise end has an upper surface and a lower surface, the upper surface and the lower surface has a notch and an angled step; and such that when the second lengthwise end is inserted into the channel, the angled step displaces the protrusion until the protrusion engages with the notch.

9. The soffit panel of claim 8, whereas a first leg of the two legs has a first protrusion and a second leg of the two legs has a second protrusion, the first protrusion facing the second protrusion.

10. The soffit panel of claim 8, whereas a first non-lengthwise end has a left hook and a distal second non-lengthwise end has a right hook for connecting adjacent soffit panels to each other.

11. The soffit panel of claim 8, wherein the upper surfaces have orifices.

12. A soffit system comprising:

a channel for affixing to a structure, the channel having a base, a first leg, and a second leg, a first end of the first leg connects to the base at approximately 90 degrees and a first end of the second leg connects to the base at the approximately 90 degrees, the first leg has a first catch and the second leg has a second catch, the first catch is on a side of the first leg that is towards the second leg and the second catch is on a side of the second leg that is towards the first leg;

a soffit panel having a first lengthwise side and a second lengthwise side, the first lengthwise side having an upper notch and a lower notch;

an end of the first lengthwise side comprises an upper angled step and a lower angled step; and when inserting the first lengthwise side into the channel between the first catch and the second catch the upper angled step displaces the first catch and the lower angled step displaces the second catch until the first catch enters the upper notch and the second catch enters the lower notch, thereby locking the first lengthwise side of the soffit panel in the channel.

13. The soffit system of claim 12, whereas the first catch meets the first leg at the approximately 90 degrees and the second catch meets the second leg at the approximately 90 degrees.

14. The soffit system of claim 12, whereas an edge of the first catch that is closest to the base meets the first leg at an angle, the angle being less than 90 degrees, and an edge of the upper notch that is closest to the upper angled step meets the upper notch at the angle.

15. The soffit system of claim 14, whereas an edge of the second catch that is closest to the base meets the second leg at the angle and an edge of the lower notch that is closest to the lower angled step meets the lower notch at the angle.

16. The soffit system of claim 12, wherein the base of the channel includes an orifice for accepting a fastener for affixing the channel to the structure.

17. The soffit system of claim 12, wherein the soffit panel and/or the channel comprise aluminum.

18. The soffit system of claim 12, wherein the soffit panel and/or the channel comprise plastic.

19. The system for securing the end of the soffit panel to the wall of the structure of claim 3, whereas the means for locking comprises an upper notch on an upper surface of the soffit panel and a lower notch on a lower surface of the soffit panel, an edge of the first catch that is closest to the base meets the first leg at an angle, the angle being less than 90 degrees, and an edge of the upper notch that is closest to the upper angled step meets the upper notch at the angle and an edge of the second catch that is closest to the base meets the second leg at the angle and an edge of the lower notch that is closest to the lower angled step meets the lower notch at the angle.

20. The soffit panel of claim 8, whereas an edge of the protrusion that is closest to the base meets a respective leg at an angle, the angle being less than 90 degrees, and an edge of the notch that is closest to the angled step meets the notch at the angle.

* * * * *